US009001166B2

(12) United States Patent
Takeda et al.

(10) Patent No.: US 9,001,166 B2
(45) Date of Patent: Apr. 7, 2015

(54) VIDEO DISPLAY DEVICE

(75) Inventors: Michiaki Takeda, Osaka (JP); Eishi Oda, Osaka (JP); Hiroyoshi Kure, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 14/234,258

(22) PCT Filed: Jun. 27, 2012

(86) PCT No.: PCT/JP2012/066405

§ 371 (c)(1),
(2), (4) Date: Jan. 22, 2014

(87) PCT Pub. No.: WO2013/018472

PCT Pub. Date: Feb. 7, 2013

(65) Prior Publication Data

US 2014/0160181 A1 Jun. 12, 2014

(30) Foreign Application Priority Data

Aug. 4, 2011 (JP) ..... 2011-170825
Jun. 25, 2012 (JP) ..... 2012-141735

(51) Int. Cl.
*G09G 5/10* (2006.01)
*G09G 3/20* (2006.01)
(Continued)

(52) U.S. Cl.
CPC ..... *G09G 3/2007* (2013.01); *G09G 3/342* (2013.01); *G09G 3/32* (2013.01); *G09G 3/3406* (2013.01);
(Continued)

(58) Field of Classification Search
None
See application file for complete search history.

(56) References Cited

U.S. PATENT DOCUMENTS

2010/0295767 A1 11/2010 Lee et al.

FOREIGN PATENT DOCUMENTS

JP 2006-10794 A 1/2006
JP 2006-129105 A 5/2006
(Continued)

OTHER PUBLICATIONS

International Search Report Issued in PCT/JP2012/066405, mailed on Sep. 11, 2012.

*Primary Examiner* — Nicholas Lee
(74) *Attorney, Agent, or Firm* — Birch, Stewart, Kolasch & Birch, LLP

(57) ABSTRACT

The present invention effectively suppresses not only occurrences of halos but also degradation of the black level. This image display device has a liquid crystal panel (17) that displays images according to an image signal and a backlight (14) in which LEDs are used and controls the light emission brightness of the LEDs for each division region, which is obtained by dividing the backlight (14) into a plurality of regions, on the basis of a prescribed relation between a gradation value for an image region corresponding to each division region and the LED light emission brightness. When the gradation value for an image satisfies prescribed conditions, a first luminance adjusting portion (12*a*) adjusts the LED light emission brightness such that the range of variation in LED light emission brightness in a first range for the gradation value of the image region, which is determined on the basis of the prescribed conditions above, is smaller than the range of variations for the LED light emission brightness that is determined on the basis of the prescribed relation above, and a second luminance adjusting portion (12*b*) adjusts the LED light emission brightness in a second range for which the value is smaller than the first range such that the light emission brightness is smaller than a lower limit value for the LED light emission brightness adjusted above.

11 Claims, 17 Drawing Sheets

(51) Int. Cl.

| | |
|---|---|
| ***G09G 3/34*** | (2006.01) |
| ***G09G 3/32*** | (2006.01) |
| ***G09G 3/36*** | (2006.01) |

(52) U.S. Cl.

CPC ..... *G09G 3/36* (2013.01); *G09G 2320/0238* (2013.01); *G09G 2320/0242* (2013.01); *G09G 2320/0646* (2013.01); *G09G 2320/0686* (2013.01); *G09G 2360/16* (2013.01)

(56) References Cited

FOREIGN PATENT DOCUMENTS

| | | | |
|---|---|---|---|
| JP | 2008-15207 | A | 1/2008 |
| JP | 2010-79236 | A | 4/2010 |
| JP | 2010-175913 | A | 8/2010 |
| JP | 2011-59177 | A | 3/2011 |
| WO | WO 2010/024465 | A1 | 3/2010 |
| WO | WO 2010/135438 | A1 | 11/2010 |

FIG. 5
(A)
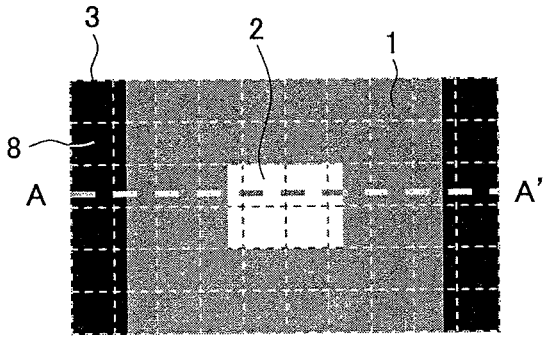
(B)
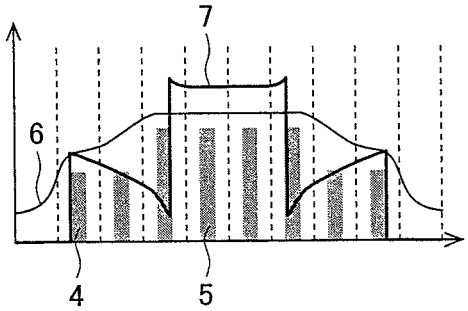
(C)
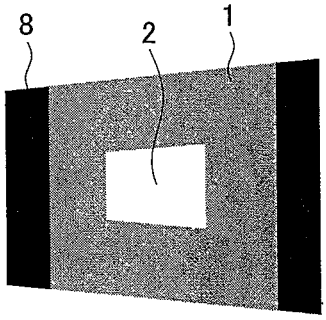

FIG. 9

(A)

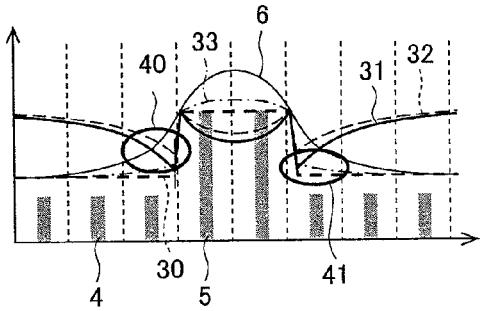

LED LIGHT EMISSION LUMINANCE 4, 5

BL LUMINANCE DISTRIBUTION 6

LCD TRANSMITTANCE (OBLIQUE VIEW) 32

DISPLAY LUMINANCE (EXPECTATION) 30

LCD TRANSMITTANCE (FRONT VIEW) 31

DISPLAY LUMINANCE (OBLIQUE VIEW) 33

(B)

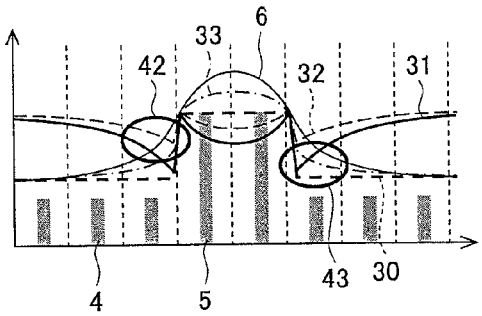

LED LIGHT EMISSION LUMINANCE 4, 5

BL LUMINANCE DISTRIBUTION 6

LCD TRANSMITTANCE (OBLIQUE VIEW) 32

DISPLAY LUMINANCE (EXPECTATION) 30

LCD TRANSMITTANCE (FRONT VIEW) 31

DISPLAY LUMINANCE (OBLIQUE VIEW) 33

FIG. 10

(A)

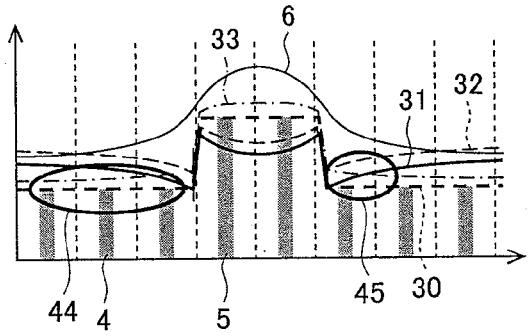

LED LIGHT EMISSION LUMINANCE 4, 5

BL LUMINANCE DISTRIBUTION 6

LCD TRANSMITTANCE (OBLIQUE VIEW) 32

DISPLAY LUMINANCE (EXPECTATION) 30

LCD TRANSMITTANCE (FRONT VIEW) 31

DISPLAY LUMINANCE (OBLIQUE VIEW) 33

(B)

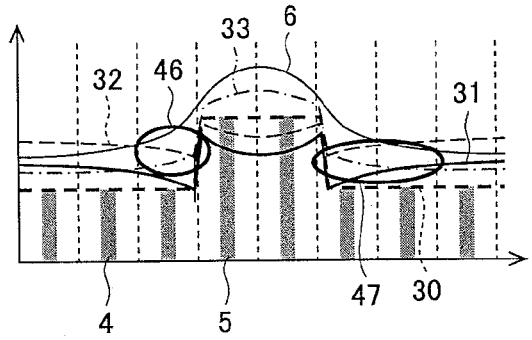

LED LIGHT EMISSION LUMINANCE 4, 5

BL LUMINANCE DISTRIBUTION 6

LCD TRANSMITTANCE (OBLIQUE VIEW) 32

DISPLAY LUMINANCE (EXPECTATION) 30

LCD TRANSMITTANCE (FRONT VIEW) 31

DISPLAY LUMINANCE (OBLIQUE VIEW) 33

FIG. 11

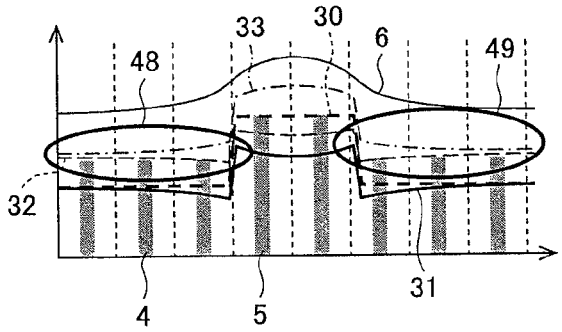

LED LIGHT EMISSION LUMINANCE 4, 5

BL LUMINANCE DISTRIBUTION 6

LCD TRANSMITTANCE (OBLIQUE VIEW) 32

DISPLAY LUMINANCE (EXPECTATION) 30

LCD TRANSMITTANCE (FRONT VIEW) 31

DISPLAY LUMINANCE (OBLIQUE VIEW) 33

FIG. 12

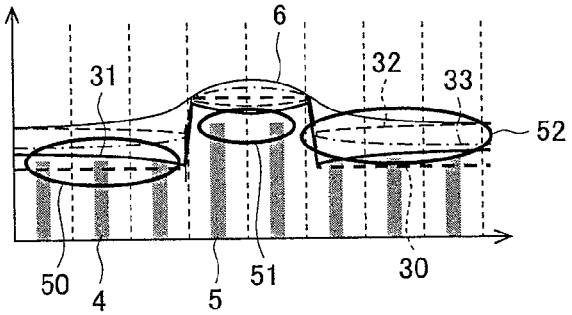

LED LIGHT EMISSION LUMINANCE 4, 5

BL LUMINANCE DISTRIBUTION 6

LCD TRANSMITTANCE (OBLIQUE VIEW) 32

DISPLAY LUMINANCE (EXPECTATION) 30

LCD TRANSMITTANCE (FRONT VIEW) 31

DISPLAY LUMINANCE (OBLIQUE VIEW) 33

FIG. 15
(A)
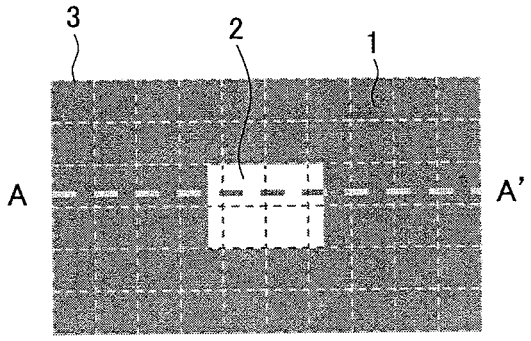
(B)
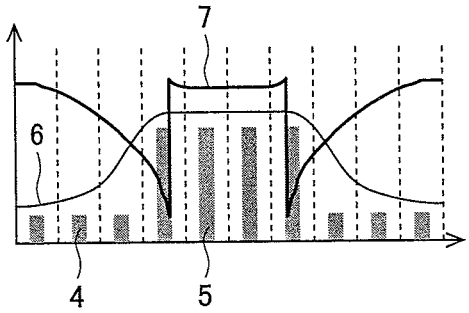
(C)
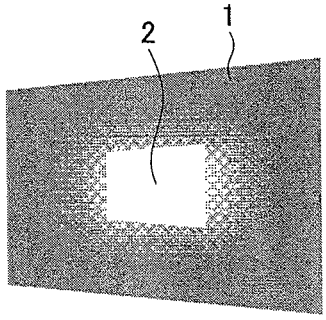

FIG. 16
(A)
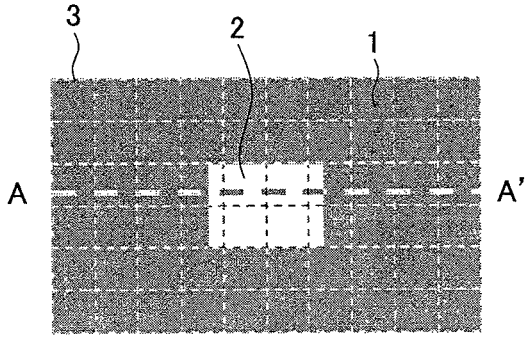
(B)
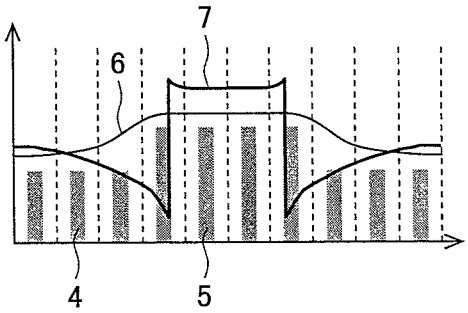
(C)
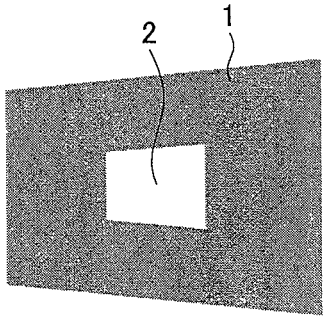

FIG. 17
(A)
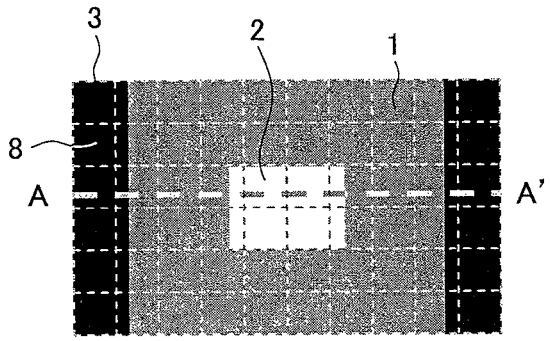
(B)
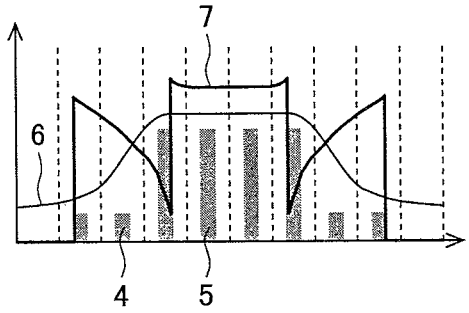
(C)
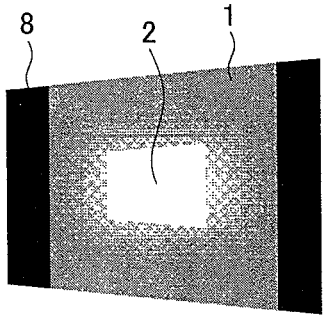

FIG. 18
(A)
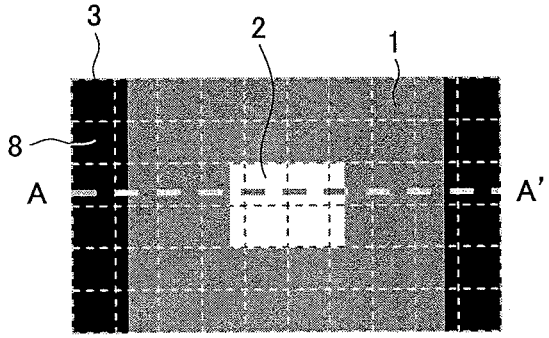
(B)
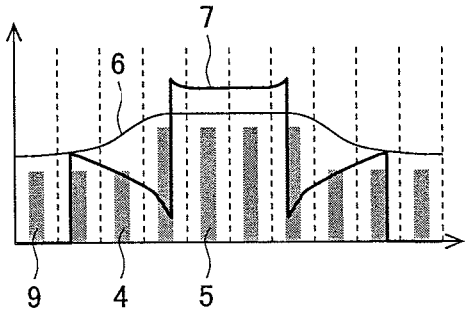
(C)
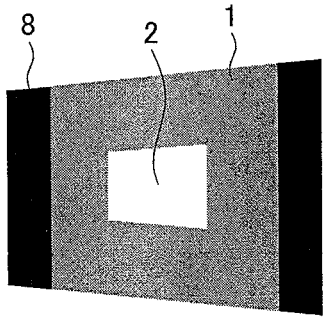

VIDEO DISPLAY DEVICE

TECHNICAL FIELD

The present invention relates to a video display device having a display panel that displays a video in accordance with a video signal and a backlight that uses LEDs as light sources for illuminating the display panel, the video display device controlling a light emission luminance of the LEDs, for each of regions obtained by dividing the backlight into plural regions, based on a predetermined relationship between a gradation value of a video region corresponding to each of the regions obtained by the division and the light emission luminance of the LEDs.

BACKGROUND OF THE INVENTION

In recent years, a video display device is becoming widespread that uses an LED (light emitting diode) backlight for illuminating a display panel. The LED backlight has an advantage of enabling the use of a local dimming technique. The local dimming is a technique that divides the backlight into plural regions to control a light emission of the LED for each of the regions depending on a luminance value of a video region corresponding to each of the regions.

When viewing obliquely a video displayed using the local dimming technique, some videos may suffer halos. For example, when viewing obliquely a video including a high-luminance pattern in a pattern with a substantially uniform luminance, there may appear halos due to a light leak around the high-luminance pattern.

FIG. 15 depicts an example of a video with halos appearing thereon. In FIG. 15(A), a video is depicted which includes a white pattern 2 in a substantially uniform gray pattern 1. FIG. 15(A) depicts backlight divided regions 3 superimposed on the video.

FIG. 15(B) depicts light emission luminances 4 and 5 of LEDs along line A-A' of FIG. 15(A), a backlight luminance distribution 6 obtained by light emission of the LEDs, and an output gradation value 7 of a liquid crystal panel. In the local dimming, the light emission luminances 4 and 5 of the LEDs in each divided region 3 are decided depending on the gradation value of each video region corresponding to each divided region 3. In FIG. 15(B), a maximum value of gradation values of pixels contained in each video region is used as the gradation value of each video region.

In this example, the light emission luminance 4 of the LEDs in the divided regions 3 completely included in the gray pattern 1 is decided to be lower than the light emission luminance 5 of the LEDs in the divided regions 3 completely or partially included in the white pattern 1. The output gradation value 7 of the liquid crystal panel is decided such that the picture quality of a finally displayed video is equivalent to that of an original video, based on the backlight luminance distribution 6 obtained as a result of the LEDs' light emission.

However, in case that there is a large difference between the light emission luminance 4 of the LEDs corresponding to the gray pattern 1 and the light emission luminance 5 of the LEDs corresponding to the white pattern 2, when viewing the video obliquely, a halo may appear around the white pattern 2 due to a light leak as depicted in FIG. 15(C). To restrain such appearance of the halo, there exists a technique for increasing the luminance of LEDs illuminating a dark portion of a video (see Patent Document 1).

FIG. 16 is an explanatory view of this conventional technique. FIG. 16(A) is the same diagram as FIG. 15(A). In this conventional technique, as depicted in FIG. 16(B), the light emission luminance 4 of the LEDs corresponding to the gray pattern 1 is increased so that the difference becomes smaller between the light emission luminance 4 and the light emission luminance 5 of the LEDs corresponding to the white pattern 2. This restrains the halo from appearing around the white pattern 2 as depicted in FIG. 16(C).

PRIOR ART DOCUMENT

Patent Documents

Patent Document 1: Japanese Laid-Open Patent Publication No. 2010-79236

SUMMARY OF THE INVENTION

Problem to be Solved by the Invention

However, if applying the conventional technique of Patent Document 1 to a video including a black pattern, there may appear black float due to the increased light emission luminance of LEDs in divided regions corresponding to a video region of the black pattern.

FIG. 17 depicts an example of a video including a black pattern. As depicted in FIG. 17(A), this video includes a black pattern 8 as well as the white pattern 2 in the substantially uniform gray pattern 1.

In the local dimming not using the conventional technique of Patent Document 1, as depicted in FIG. 17(B), the light emission luminance 4 of LEDs in the divided regions 3 completely included in the gray pattern 1 is decided to be lower than the light emission luminance 5 of LEDs in the divided regions 3 completely or partially included in the white pattern 2. The light emission luminance of LEDs in the divided regions 3 completely included in the black pattern 8 is substantially zero.

In this case, black float in the black pattern 8 is hardly seen. Similar to the example of FIG. 15, however, if there is a large difference between the light emission luminance 4 of LEDs corresponding to the gray pattern 1 and the light emission luminance 5 of LEDs corresponding to the white pattern 2, when the video viewed obliquely, a halo may appear around the white pattern 2 as depicted in FIG. 17(C).

FIG. 18 is an explanatory view of applying the conventional technique of Patent Document 1 to a video including a black pattern. FIG. 18(A) is the same diagram as FIG. 17(A). Since the conventional technique of Patent Document 1 equally increases not only the light emission luminance 4 of LEDs corresponding to the gray pattern 1 but also a light emission luminance 9 of LEDs corresponding to the black pattern 8 as depicted in FIG. 18(B), black float in the black pattern 8 may become conspicuous though the halo can be restrained from appearing around the white pattern 2.

In view of the above problems, an object of the present invention is to provide a video display device capable of effectively suppressing not only the appearance of halos but also black float.

Means for Solving the Problem

To solve the above problems, a first technical means of the present invention is a video display device having a display panel that displays a video in accordance with a video signal and a backlight that uses LEDs as light sources for illuminating the display panel, the video display device controlling a light emission luminance of the LEDs, for each of regions obtained by dividing the backlight into a plurality of regions, based on a predetermined relationship between a gradation value of a video region corresponding to each of the regions obtained by the division and the light emission luminance of the LEDs, the video display device comprising: a first luminance adjusting portion that, if a gradation value of the video meets a predetermined condition, adjusts the light emission luminance of the LEDs such that a variation range of the light emission luminance of the LEDs in a first range, defined based on the predetermined condition, of the gradation value of the video region is smaller than a variation range of the light emission luminance of the LEDs defined based on the predetermined relationship; and a second luminance adjusting portion that adjusts the light emission luminance of the LEDs so as to be a smaller light emission luminance than a lower limit value of the light emission luminance of the LEDs adjusted by the first luminance adjusting portion in a second range smaller in value than the first range.

And the first technical means is the video display device, wherein the predetermined condition is a condition that, when producing a frequency distribution of the gradation value of the video and extracting upper two gradation values having greater frequencies in a gradation range where the gradation value of the video is greater than a predetermined gradation value, a ratio of a sum of frequencies of the upper two gradation values to a sum of frequencies of the gradation values in the gradation range is greater than a predetermined ratio.

A second technical means is the video display device of the first technical means, wherein the predetermined ratio is set to different ratios between a case of determining whether the gradation value of the video meets the predetermined condition in a state where the gradation value of the video does not meet the predetermined condition and a case of determining whether the gradation value of the video meets the predetermined condition in a state where the gradation value of the video meets the predetermined condition.

A third technical means is the video display device of the first technical means, wherein the first luminance adjusting portion adjusts the light emission luminance of the LEDs if the gradation value of the video having a plurality of frames meets the predetermined condition consecutively over a predetermined number of or more frames.

A fourth technical means is the video display device of the first technical means, wherein the first luminance adjusting portion adjusts the light emission luminance of the LEDs in the first range so as to be a light emission luminance smaller than a light emission luminance of the LEDs that is decided based on the predetermined relationship at an upper limit value of the first range.

A fifth technical means is the video display device of the first technical means, wherein the first luminance adjusting portion adjusts the light emission luminance of the LEDs in the first range so as to be a light emission luminance of the LEDs that is decided based on the predetermined relationship at an upper limit value of the first range.

A sixth technical means is the video display device of the first technical means, wherein if the second luminance adjusting portion detects that a ratio of the number of pixels having a gradation value smaller than a predetermined gradation value to the total pixels exceeds a predetermined ratio in the video signal, the second luminance adjusting portion adjusts only the light emission luminance of the LEDs so as to be smaller than a light emission luminance before the detection in the second range.

A seventh technical means is the video display device of the first technical means, further comprising an illuminance detecting portion that detects an ambient illuminance of the video display device, wherein if it is detected that the ambient illuminance is smaller than a predetermined value, the second luminance adjusting portion adjusts the light emission luminance of the LEDs so as to be smaller than the light emission luminance before the detection in the second range.

An eighth technical means is the video display device of the first technical means, wherein when accepting a specification of a video display mode, the first luminance adjusting portion adjusts the light emission luminance of the LEDs using a relationship previously defined depending on the type of the video display mode such that a variation range of the light emission luminance of the LEDs in the first range of the gradation value of the video region is smaller than a variation range of the light emission luminance of the LEDs decided based on the predetermined relationship, and wherein the second luminance adjusting portion adjusts the light emission luminance of the LEDs using the relationship previously defined depending on the type of the video display mode so as to be a light emission luminance smaller in the second range than the lower limit value of the light emission luminance of the LEDs adjusted by the first luminance adjusting portion.

A ninth technical means is the video display device of the first technical means, wherein when adjusting the light emission luminance of the LEDs, the first luminance adjusting portion and/or the second luminance adjusting portion performs, over a predetermined number of frames, a stepwise change from a light emission luminance before the adjustment to a light emission luminance after the adjustment.

A tenth technical means is the video display device of the first technical means, wherein the first luminance adjusting portion adjusts the light emission luminance of the LEDs so as to be a light emission luminance smaller than the light emission luminance of the LEDs that is decided based on the predetermined relationship in a third range greater in value than the first range.

An eleventh technical means is the video display device of the tenth technical means, wherein an adjustment amount Y of the light emission luminance of the LEDs in the third range is decided based on an adjustment amount X of the light emission luminance of the LEDs at a lower limit value in the first range, the frequency of a gradation value A of the video corresponding to the lower limit value of the first range, and the frequency of a gradation value B of the video corresponding to an upper limit value of the first range, from an equation $Y=X^x$ (frequency of gradation value A)/(frequency of gradation value B)×(adjustment coefficient).

Effect of the Invention

The video display device of the present invention has a display panel that displays a video in accordance with a video signal and a backlight that uses LEDs as light sources for illuminating the display panel, the video display device controlling a light emission luminance of the LEDs for each of regions obtained by dividing the backlight into plural regions, based on a predetermined relationship between a gradation value of a video region corresponding to each of the regions obtained by the division and the light emission luminance of the LEDs. Then, in the case where the gradation value of a video satisfies predetermined conditions, the LED light emission luminance is adjusted such that the variation range of the LED light emission luminance in a first range of the gradation value of a video region is smaller than the variation range of the LED light emission luminance decided based on the predetermined relationship and such that it is smaller than a lower limit value of the adjusted light emission luminance of the LEDs in a second range that is smaller in value than the first range, whereby not only the appearance of halos but also black float in a low gradation display portion can be effectively suppressed.

BRIEF DESCRIPTION OF DRAWINGS

FIG. 5 is an explanatory view of an application of the present invention to a video including a black pattern.

FIG. 9 is an explanatory view of the display luminance obtained when no halo prevention measures are made.

FIG. 10 is an explanatory view of the display luminance obtained when halo prevention measures are made.

FIG. 11 is an explanatory view of the halo suppression effected when the halo appears remarkably.

FIG. 12 is an explanatory view of a halo suppression method according to the present invention.

FIG. 15 is a view of an example of a video in which halos appear.

FIG. 16 is an explanatory view of a conventional technique.

FIG. 17 is a view of an example of a video including a black pattern.

FIG. 18 is an explanatory view of an application of the conventional technique to a video including a black pattern.

PREFERRED EMBODIMENT OF THE INVENTION

Figure 1:
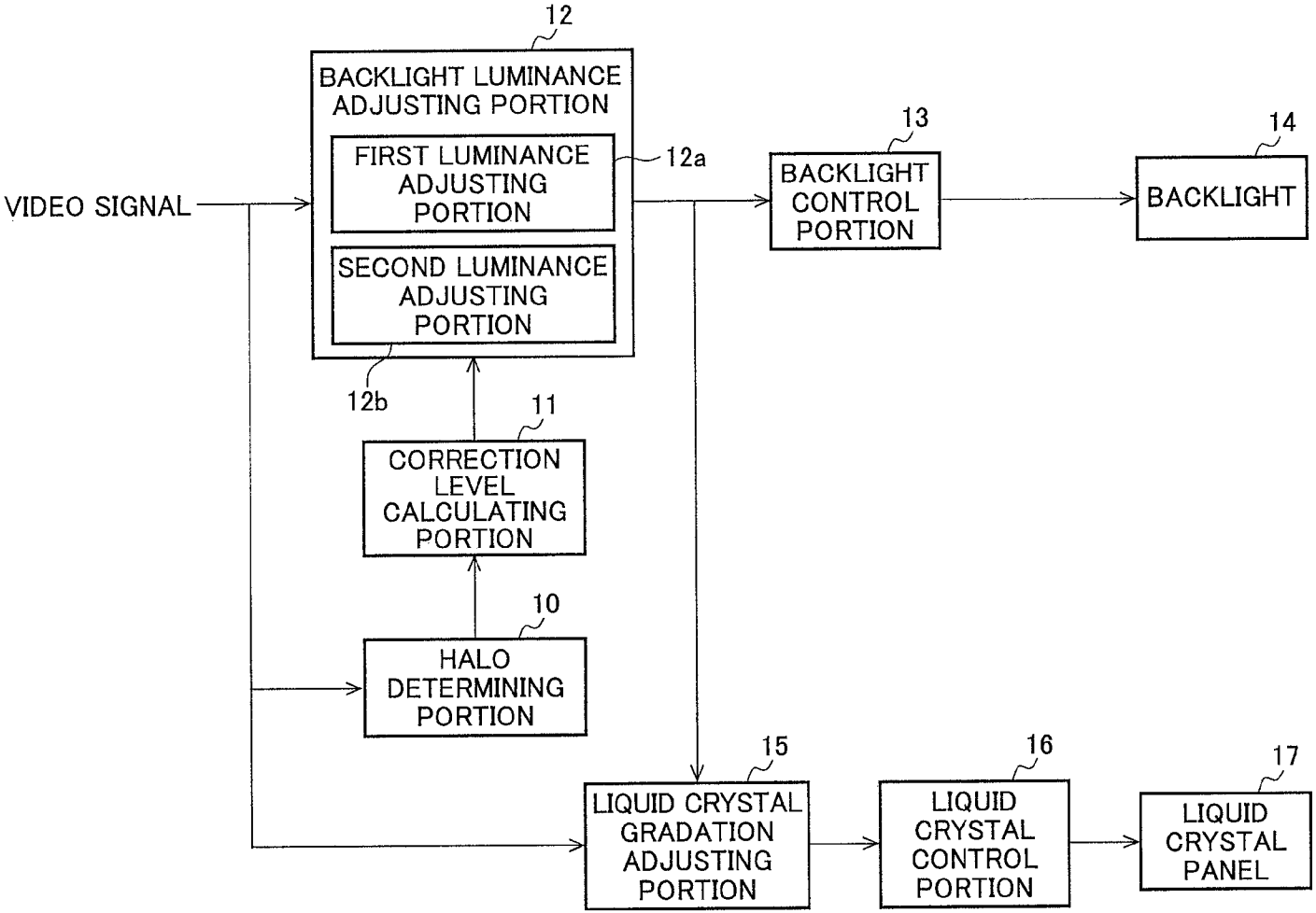
FIG. 1 is an explanatory view of a configuration example of major parts of a video display device according to the present invention.

An embodiment of the present invention will now be described in detail with reference to the drawings. FIG. 1 is an explanatory view of a configuration example of major parts of a video display device according to the present invention. The video display device is configured to perform image processing on an input video signal for displaying video and is applicable to a television apparatus, etc.

Figure 2:
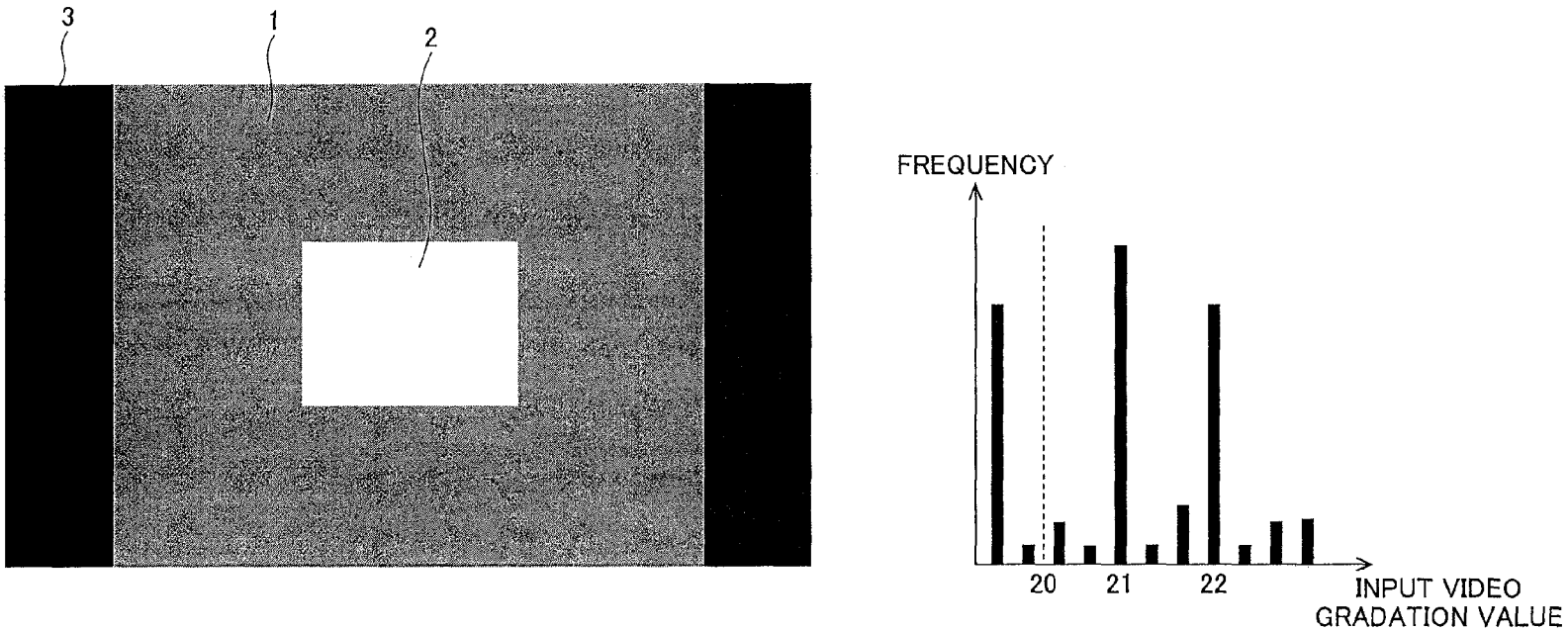
FIG. 2 is an explanatory view of an example of a method of determining whether an input video is a video in which halos are easy to appear.

A halo determining portion 10 determines whether an input video is a video in which halos easily appear. FIG. 2 is an explanatory view of an example of the determination method. FIG. 2 depicts a case where the input video includes a substantially uniform gray pattern 1, a white pattern 2, and a black pattern 3.

For example, the halo determining portion 10 produces a frequency distribution of gradation values of an input video signal and extracts upper two gradation values 21 and 22 having upper two frequencies in a range of the input video signal gradation value greater than a gradation value 20. The halo determining portion 10 calculates a sum of frequencies of the gradation values in the above range and, if the ratio of a sum of frequencies of the two gradation values 21 and 22 to the above calculated sum is greater than or equal to a predetermined ratio, determines that the input video is a video in which halos easily appear. If the ratio of the sum is less than the predetermined ratio, the halo determining portion 10 determines that the input video is not a video in which halos easily appear.

In this manner, the example of FIG. 2 makes a determination that it is a video in which halos easily appear based on the fact that the frequency distribution is bipolarized in regions other than low-gradation regions. This enables a detection of a video as depicted in FIG. 2 where the white pattern 2 having a luminance greatly different from that of the gray pattern 1 is included in the substantially uniform gray pattern 1 in portions except the black pattern 3, whereby it can be simply and effectively determined whether the video is one in which halos easily appear.

Various timings are conceivable to make a determination of whether the input video is a video in which halos easily appear. For example, the halo determining portion 10 may make the determination for each of frames or may detect a scene change to make the determination at the timing of the detection of the scene change.

Figure 3:
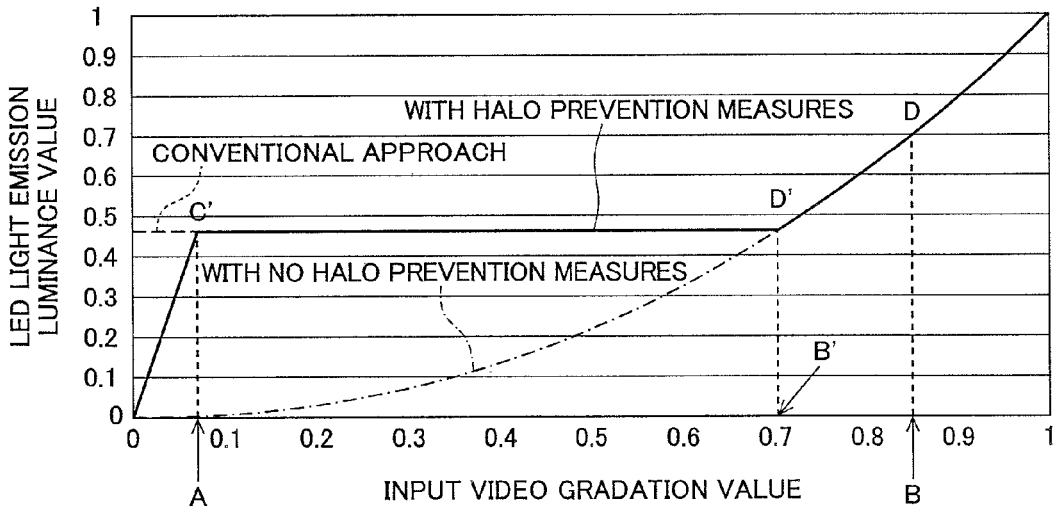
FIG. 3 is an explanatory view of a correction level calculation method of the LED light emission luminance.

A correction level calculating portion 11 calculates a correction level of the LED light emission luminance if it is determined by the halo determining portion 10 that the input video is a video in which halos easily appear. FIG. 3 is an explanatory view of a correction level calculation method of the LED light emission luminance.

A vertical axis of FIG. 3 represents an LED light emission luminance value and a horizontal axis thereof represents an input video gradation value. The vertical axis and the horizontal axis are normalized using a maximum LED light emission luminance value and a maximum input video gradation value, respectively.

If it is determined by the halo determining portion 10 that the input video is not a video in which halos easily appear, local dimming is performed based on a dashed dotted line graph of FIG. 3. Specifically, in the local dimming, a backlight is divided into plural regions so that a gradation value of a video region corresponding to each divided region is detected. In this case, a maximum value or a mean value of gradation values of pixels contained in the video region is used as the gradation value of the video region. The LED light emission luminance of each divided region is decided from a relationship indicated by the dashed dotted line graph of FIG. 3 using the video region gradation value as an input video gradation value.

If it is determined by the halo determining portion 10 that the input video is a video in which halos easily appear, the graph used to decide the LED light emission luminance is switched from the dashed dotted line graph of FIG. 3 to a solid line graph as described below so that the LED light emission luminance of each divided region is decided by use of the solid line graph. Although the dashed dotted curved line graph is set based on 2.2 gamma characteristics in the example of FIG. 3, the relationship between the LED light emission luminance value and the input video gradation value may be represented by a straight line graph, and the dashed dotted line graph is defined in accordance with the definition of the input video gradation, i.e., so that the luminance expressed by the input video gradation is figured out.

The correction level calculating portion 11 sets the correction level correcting the dashed dotted line of FIG. 3 so as to be indicated by the solid line graph of FIG. 3. In the solid line graph of FIG. 3, the variation range (the variation range is zero in the example of FIG. 3) of the LED light emission luminance defined from a straight line C'D' is set to be smaller in the range of input video gradation values A to B' than the variation range (the difference between the LED light emission luminance corresponding to the input video gradation value B' and the LED light emission luminance corresponding to the input video gradation value A) of the LED light emission luminance defined based on the dashed dotted line. As a result, the appearance of halos in the input video can be effectively suppressed.

In the range of input video gradation values O to A, the LED light emission luminance value defined based on a straight line OC' is set to be smaller than the lower limit value (the LED light emission luminance value corresponding to the input video gradation value A in the example of FIG. 3) of the LED light emission luminance defined based on the straight line C'D'.

Since the LED light emission luminance value of the input video gradation values O to A is set to be smaller than the level (the level indicated as the conventional approach in FIG. 3) of the light emission luminance value of the conventional technique of Patent Document 1, black float can be effectively suppressed in the low gradation region of the input video.

The range of the input video gradation values A to B' corresponds to a first range in the claims and the range of the input video gradation values O to A corresponds to a second range in the claims. As will be described later, the upper limit for adjusting the LED light emission luminance value may be an input video gradation value B instead of the input video gradation value B'. In this case, the range of the input video gradation values A to B corresponds to the first range in the claims.

Figure 4:
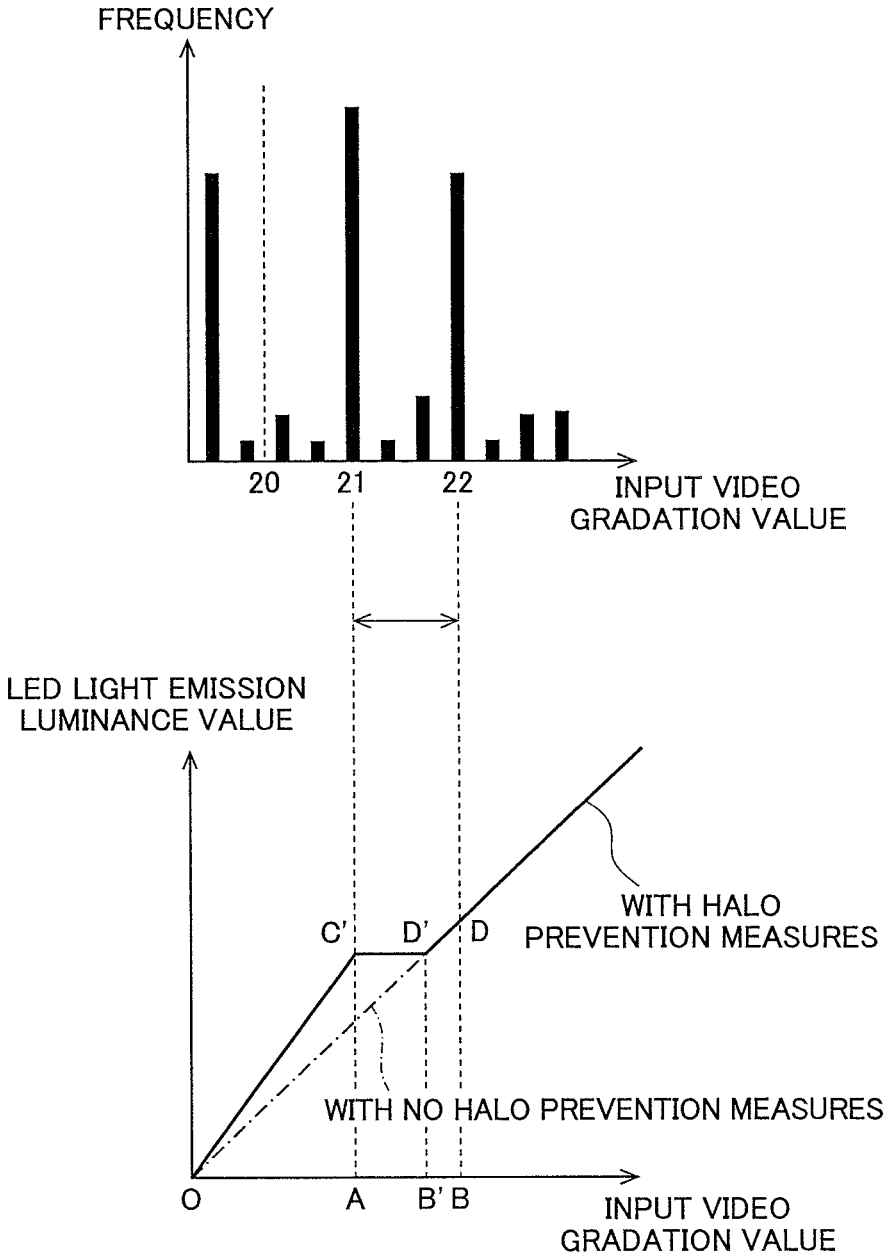
FIG. 4 is an explanatory view of a method of deciding input video gradation values A and B' in FIG. 3.

The correction level calculating portion 11 decides the input video gradation values A and B' as follows for example. FIG. 4 is an explanatory view of a method of deciding the input video gradation values A and B' in FIG. 3. Although in FIG. 4 the relationship between the LED light emission luminance value and the input video gradation value is represented by a straight line graph, the input video gradation values A and B' may be decided in the same manner for the curve line graph expressed by the dashed dotted line of FIG. 3.

As described with reference to FIG. 2, when determining whether the input video is a video in which halos easily appear, the halo determining portion 10 produces a frequency distribution of input video gradation values and extracts upper two gradation values 21 and 22 having greater frequencies in the range of the input video gradation value greater than the predetermined gradation value 20.

If it is determined by the halo determining portion 10 that the input video is a video in which halos easily appear, the correction level calculating portion 11 sets the input video gradation values A and B to the two gradation values 21 and 22. To reduce the amount of power consumption arising from the light emission of the LEDs, the correction level calculating portion 11 modifies the input video gradation value B to the input video gradation value B'. It is decided through previous experiments, etc., to what degree the input video gradation value B is to be decreased.

In order not to calculate the LED light emission luminance correction level when it is determined by the halo determining portion 10 that the input video is not a video in which halos easily appear, the correction level calculating portion 11 may set negative values as the input video gradation values A and B', may set B'=A, or may output information of detection/non-detection to a backlight luminance adjusting portion 12 that will be described below.

Returning to the description of FIG. 1, the backlight luminance adjusting portion 12 adjusts the LED light emission luminance. Specifically, the backlight luminance adjusting portion 12 divides the backlight into plural regions and detects a gradation value of a video region of an input video corresponding to each of the divided regions. For example, the backlight luminance adjusting portion 12 detects a maximum value or a mean value of gradation values of pixels contained in the video region as a gradation value of a video region.

The backlight luminance adjusting portion 12 then acquires information of the input video gradation values A and B' from the correction level calculating portion 11. The input video gradation values A and B' are calculated by the correction level calculating portion 11 on a frame-by-frame basis or at a timing when a scene change is detected.

In the case where the input video is determined not to be a video in which halos easily appear such as when the input video gradation values A and B' are negative values, the backlight luminance adjusting portion 12 decides a light emission luminance value of LEDs in a divided region corresponding to the gradation value of each video region, for each of frames, in accordance with the relationship indicated by the dashed dotted line graph of FIG. 3.

In the case where the input video is determined to be a video in which halos easily appear such as when the input video gradation values A and B' are not negative values, the backlight luminance adjusting portion 12 decides a light emission luminance value of LEDs in a divided region corresponding to the gradation value of each video region, for each of frames, in accordance with the relationship indicated by the solid line graph of FIG. 3.

Specifically, a first luminance adjusting portion 12*a* of the backlight luminance adjusting portion 12 decides the LED light emission luminance value of a divided region corresponding to a video region having a gradation value between the input video gradation values A and B' as being a constant value (the LED light emission luminance value corresponding to the input video gradation value B') in accordance with the relationship indicated by the straight line C'D'.

A second luminance adjusting portion 12*b* decides the LED light emission luminance value of a divided region corresponding to a video region having a gradation value between input video gradation values O and A as being a value between O and an LED light emission luminance value corresponding to the input video gradation value B', in accordance with the relationship indicated by a straight line OC'.

The backlight luminance adjusting portion 12 holds equations expressing the dashed dotted line graph and the solid line graph of FIG. 3 and calculates a light emission luminance value corresponding to an input video gradation value using the equations. The backlight luminance adjusting portion 12 may hold a table numerically representing the dashed dotted line graph and the solid line graph of FIG. 3 and refer to the table to decide an LED light emission luminance value corresponding to an input video gradation value.

Referring back to FIG. 1, a backlight control portion 13 controls LEDs of a backlight 14 to allow the LEDs to emit light at an LED light emission luminance value of each of the divided regions that is decided by the backlight luminance adjusting portion 12. The backlight 14 is a backlight that uses LEDs as light sources for illuminating a liquid crystal panel 17.

A liquid crystal gradation adjusting portion 15 acquires information of an LED light emission luminance value of each divided region that is decided by the backlight luminance adjusting portion 12 and acquires an input video signal to decide an output gradation value of the liquid crystal panel such that the picture quality of a finally obtained video is equivalent to the picture quality of the input video.

A liquid crystal control portion 16 controls the liquid crystal panel 17 to allow the liquid crystal panel 17 to perform a liquid crystal display at an output gradation value decided by the liquid crystal gradation adjusting portion 15. The liquid crystal panel 17 is a liquid crystal panel that displays a video corresponding to an input video signal. The backlight control portion 13 and liquid crystal control portion 16 control the backlight 14 and the liquid crystal panel 17, respectively, such that the light emission of the backlight 14 is synchronized with the display of the liquid crystal panel 17.

FIG. 5 is an explanatory view of applying the present invention to a video including a black pattern. FIG. 5(A) is the same diagram as FIG. 17(A). In the present invention, as depicted in FIG. 5(B), the light emission luminance 4 of LEDs corresponding to the gray pattern 1 is increased as compared with the case of FIG. 17(B), without increasing the light emission luminance of LEDs corresponding to the black pattern 8.

In the case of FIG. 18(B), the light emission luminance of LEDs corresponding to the black pattern 8 is also increased and hence there is a possibility that black float may become conspicuous. In the present invention, however, the light emission luminance of LEDs corresponding to the black pattern 8 is not increased so that black float can be suppressed and the appearance of a halo around the white pattern 2 can be suppressed as depicted in FIG. 5(C).

Although the embodiment of the video display device has heretofore been described, the present invention is not limited to the above embodiment but can be variously modified or altered without departing from the spirit of the present invention.

Figure 6:
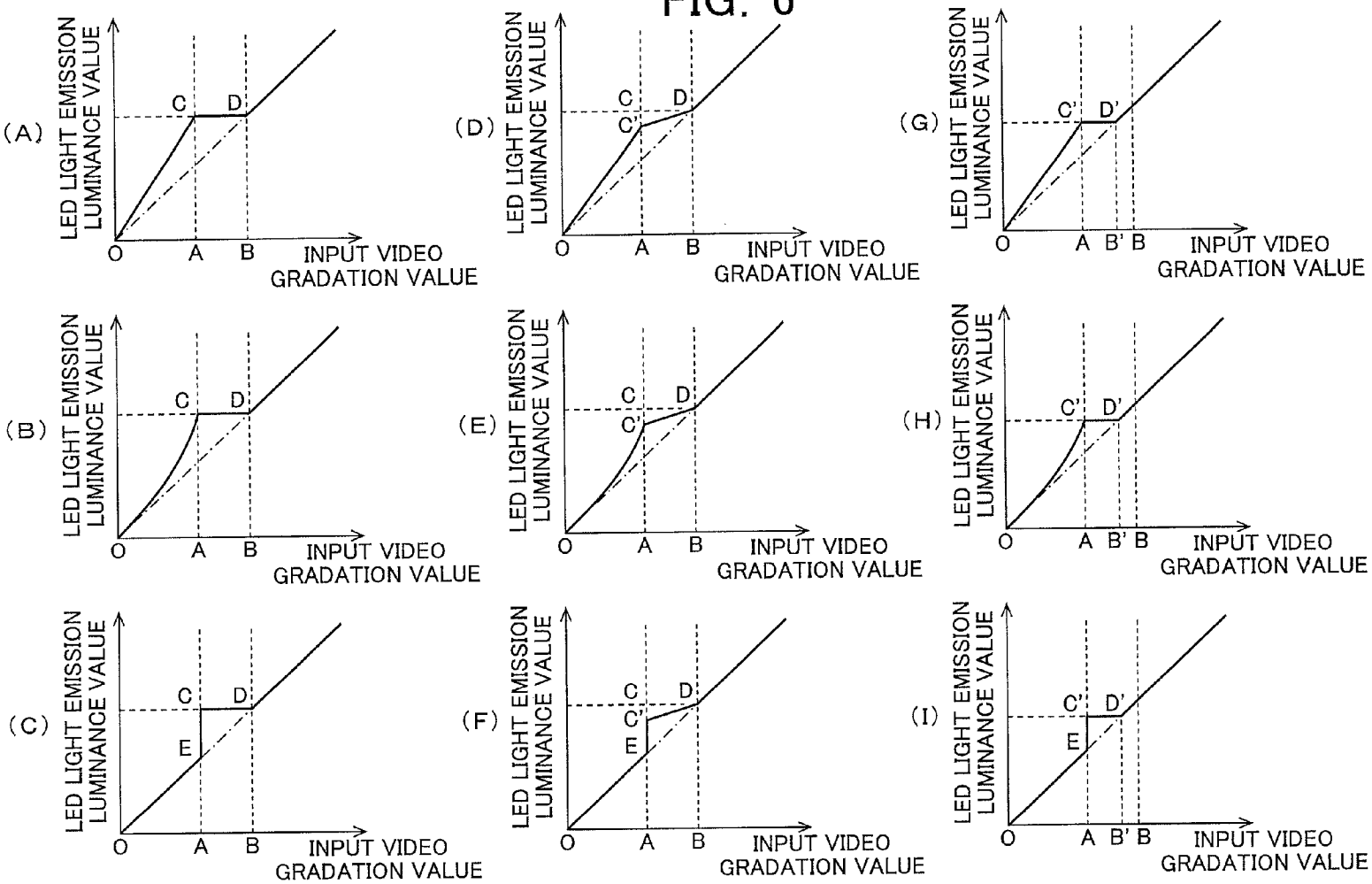
FIG. 6 is a view of various graphs for use in a decision of the LED light emission luminance value.

For example, although in the above embodiment the LED light emission luminance value is decided using the relationship indicated by the solid line graph of FIG. 3 if the input video is determined to be a video in which halos easily appear, the graph for deciding the LED light emission luminance value is not limited to the one depicted in FIG. 3. FIG. 6 depicts various graphs used to decide the LED light emission luminance.

In FIG. 6(A), the input video gradation values A and B described in FIG. 4 are used and the light emission luminance value of LEDs of divided regions corresponding to video regions having a gradation value between the input video gradation values A and B is decided to be a constant value (the LED light emission luminance value corresponding to the input video gradation value B) in accordance with the relationship expressed by the straight line CD.

The light emission luminance value of LEDs of divided regions corresponding to video regions having a gradation value between the input video gradation values O and A is decided to be a value between O and an LED light emission luminance value corresponding to the input video gradation value B in accordance with the relationship expressed by the straight line OC.

In FIG. 6(B), the straight line OC of FIG. 6(A) is changed to a downward convex curve. In FIG. 6(C), the straight line OC of FIG. 6(A) is changed to a straight line CE and a straight line OE that is obtained when no halo prevention measures are adopted.

In FIG. 6(D), the straight line CD of FIG. 6(A) is changed to a straight line C'D having a positive slope and the straight line OC of FIG. 6(A) is changed to a straight line OC'. In FIG. 6(E), the straight line OC' of FIG. 6(D) is changed to a downward convex curve and, in FIG. 6(F), the straight line OC' of FIG. 6(D) is changed to a straight line C'E and the straight line OE that is obtained when no halo prevention measures are adopted.

In FIG. 6(G), the straight line CD of FIG. 6(A) is changed to a straight line C'D' having a slope of O similar to the straight line CD, while the straight line OC of FIG. 6(A) is changed to the straight line OC'. In FIG. 6(H), the straight line OC' of FIG. 6(G) is changed to a downward convex curve and, in FIG. 6(I), the straight line OC' of FIG. 6(G) is changed to a straight line C'E and the straight line OE that is obtained when no halo prevention measures are adopted.

In FIG. 6, the further the left solid line graph goes to upper left, the smaller the difference of the LED light emission luminance value between the input video gradation values A and B becomes, and therefore the appearance of halos can be suppressed to a greater extent. The further the solid line graph goes to lower right, the smaller the LED light emission luminance value becomes, and therefore the amount of power consumption can be reduced even more.

For example, since the LED light emission luminance value defined by the straight line CD in the solid line graph of FIG. 6(A) is larger than the LED light emission luminance value defined by the straight line C'D' in the solid line graph of FIG. 6(I), use of the solid line graph of FIG. 6(A) enables the appearance of halos to be suppressed even more whereas use of the solid line graph of FIG. 6(I) enables the amount of power consumption to be reduced even more.

Any one of the graphs depicted in FIG. 6 may be selected and may be fixedly used or a graph used may be switchable. For example, when the backlight luminance adjusting portion 12 detects that the ratio of the number of pixels having a luminance value smaller than a predetermined value to the total pixels exceeds a predetermined ratio, it may switch the graph to a graph (e.g., FIG. 6(C), (F), (I), etc.) allowing the LED light emission luminance value to become smaller, as compared with the graph used before the detection, in a region where the input video gradation value is smaller than a predetermined value. As a result, when the input video includes more black patterns, the LED light emission luminance value of divided regions corresponding to low-gradation video regions can be reduced so that the generation of black float can be suppressed.

In the cases where the video display device is provided with a light sensor and where the light sensor measures an ambient illuminance and detects that the ambient illuminance is smaller than a predetermined value, the backlight luminance adjusting portion 12 may switch the graph to a graph (e.g., FIG. 6(C), (F), (I), etc.) allowing the LED light emission luminance value to become smaller, as compared with the graph used before the detection, in a region where the input video gradation value is smaller than a predetermined value. As a result, when the ambient illuminance is low, the LED light emission luminance value of divided regions corresponding to low-gradation video regions can be reduced so that the generation of black float can be suppressed.

Video display modes such as a halo prevention measures emphasizing mode and a power consumption amount reducing mode may be associated with graphs represented by the solid lines of FIG. 6 so that the graphs of FIG. 6 are switched depending on a video display mode switching instruction received from the user. For example, the halo prevention measures emphasizing mode may be associated with the graph represented by the solid line of FIG. 6(A) and the power consumption amount reducing mode may be associated with the solid line of FIG. 6(G). This enables the LED light emission luminance to be properly controlled depending on whether the user emphasizes the halo prevention measures or emphasizes the power consumption amount reduction.

When altering the graph shape in response to a switching of the video display mode by the user or to a change of the correction level arising from a change of a video, the graph shape may be altered in a stepwise fashion to reduce the visual incongruous feeling of the video caused by a sudden switching of the LED lighting state.

Figure 7:
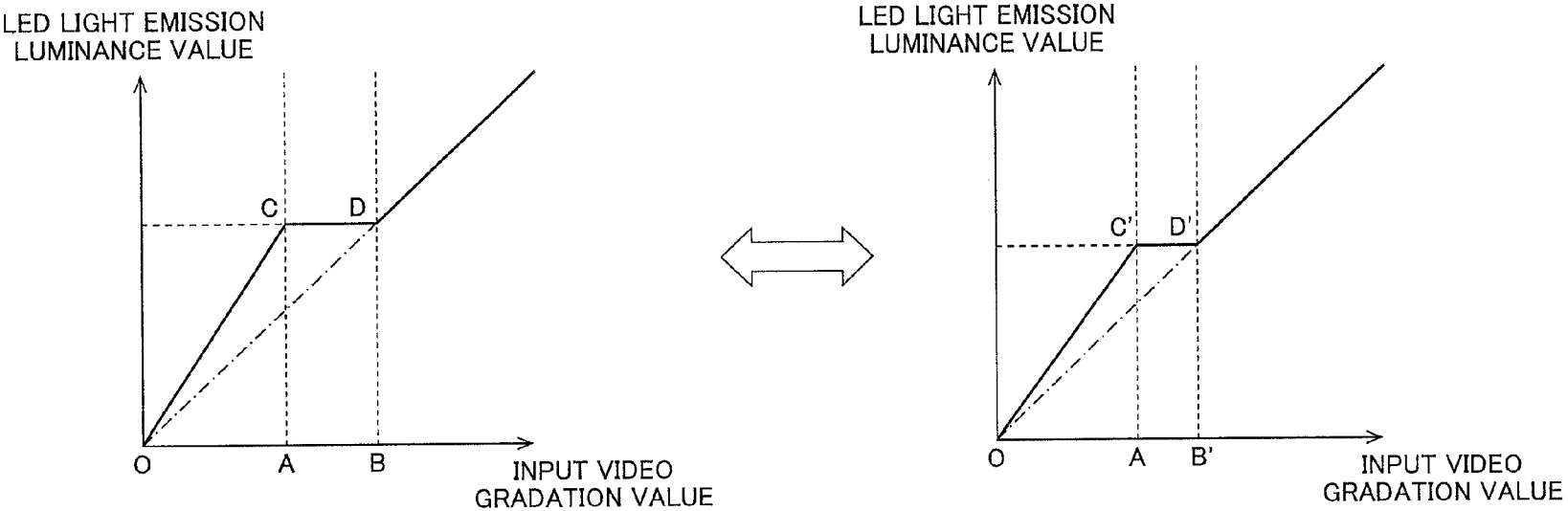
FIG. 7 is an explanatory view of alterations in graph shape when the video display mode is switched or when the correction level varies due to a change in a video.

FIG. 7 is an explanatory view of an alteration of the graph shape effected when the video display mode is switched or when the correction level is changed due to a change of a video. FIG. 7 depicts an example of altering the graph shape between a graph indicated by a solid line of FIG. 7(A) and a graph indicated by a solid line of FIG. 7(B). The graph indicated by the solid line of FIG. 7(B) differs from the graph indicated by the solid line of FIG. 7(A) in that instead of the input video gradation value B, the input video gradation value B' is used as an upper limit for adjusting the LED light emission luminance value.

When the user switches the video display mode, FIG. 7(A) is a graph emphasizing the halo prevention measures and FIG. 7(B) is a graph emphasizing the reduction in the amount of power consumption. When the input video changes, FIG. 7(A) represents a video in which halos easily appear and FIG. 7(B) represents a video in which halos are hard to appear as compared with FIG. 7(A).

For example, let the coordinate values of C, D, C', and D' be (A1$x$, A1$y$), (B1$x$, B1$y$), (A2$x$, A2$y$) and (32$x$, B2$y$), respectively. For example, when the user switches the mode from the halo prevention measures emphasizing mode to the power consumption amount reduction emphasizing mode or when the input video changes to a video in which halos are hard to appear, the backlight luminance adjusting portion 12 alters the graph shape for use in a stepwise fashion over a predetermined number of frames, from the graph indicated by the solid line of FIG. 7(A) whose graph shape is defined by the input video gradation value B to the graph indicated by the solid line of FIG. 7(B) whose graph shape is defined by the input video gradation value B'. This allows the LED light emission luminance value at an input video gradation value to be altered in a stepwise fashion.

Specifically, the backlight luminance adjusting portion 12 changes the coordinate values (A1$x$, A1$y$) of C to the coordinate values (A2$x$, A2$y$) of C' in a stepwise fashion. The backlight luminance adjusting portion 12 changes the coordinate values (B1$x$, B1$y$) of D to the coordinate values (B2$x$, B2$y$) of D' in a stepwise fashion.

Similarly, when altering the graph shape from the graph indicated by the solid line of FIG. 7(B) to the graph indicated by the solid line of FIG. 7(A), the backlight luminance adjusting portion 12 alters the graph shape for use in a stepwise fashion over a predetermined number of frames, from the graph indicated by the solid line of FIG. 7(B) to the graph indicated by the solid line of FIG. 7(A). This allows the LED light emission luminance value at an input video gradation value to be altered in a stepwise fashion.

Specifically, the backlight luminance adjusting portion 12 changes the coordinate values (A2$x$, A2$y$) of C' to the coordinate values (A1$x$, A1$y$) of C in a stepwise fashion. The backlight luminance adjusting portion 12 changes the coordinate values (B2$x$, B2$y$) of D' to the coordinate values (B1$x$, B1$y$) of D in a stepwise fashion.

When altering the graph shape between a graph on which the halo prevention measures are made and a graph on which no halo prevention measures are made after the determination of whether the input video is a video in which halos are easy to appear at the timing of detection of a scene change, the graph shape may be altered in a stepwise fashion to reduce the visual incongruous feeling of the video caused by a sudden switching of the graph shape.

Figure 8:
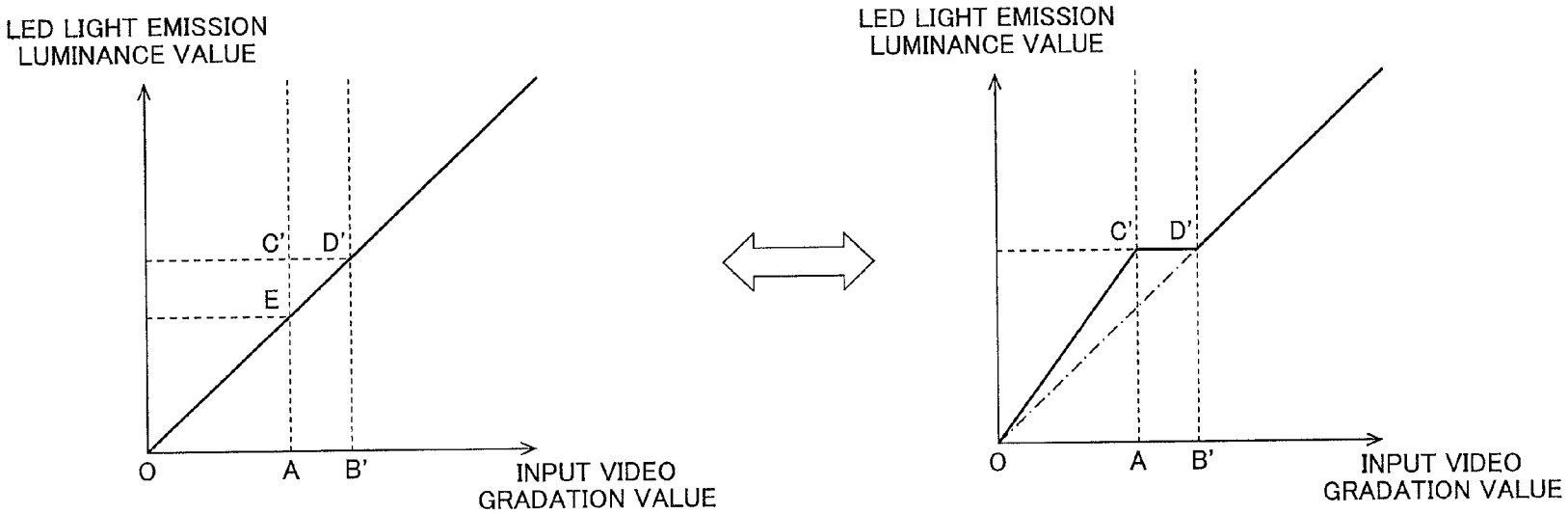
FIG. 8 is an explanatory view of alterations in graph shape effected depending on the determination of whether it is a video in which halos are easy to appear.

FIG. 8 is an explanatory view of an alteration of the graph shape performed depending on the determination of whether it is a video in which halos easily appear. FIG. 8 depicts an example of altering the graph shape between a graph indicated by a solid line of FIG. 8(A) and a graph indicated by a solid line of FIG. 8(B). The graph indicated by the solid line of FIG. 8(A) is a graph obtained when no halo prevention measures are adopted and the graph indicated by the solid line of FIG. 8(B) is a graph obtained when the halo prevention measures are adopted.

For example, let the coordinate values of C', D', and E be (A2$x$, A2$y$), (B2$x$, B2$y$), and (A2$x$, A3$y$), respectively. In the above embodiment, when a determination is made of a switching of the input video from a video in which halos do not easily appear to a video in which halos easily appear as a result of a scene change, etc., there occurs a switching of the graph from the graph indicated by the solid line of FIG. 8(A) to the graph indicated by the solid line of FIG. 8(B) until the detection of a next scene change.

At this time, the backlight luminance adjusting portion 12 alters the graph shape for use in a stepwise fashion over a predetermined number of frames, from the graph indicated by the solid line of FIG. 8(A) to the graph indicated by the solid line of FIG. 8(B). This allows the LED light emission luminance value at an input video gradation value to be altered in a stepwise fashion. Specifically, the backlight luminance adjusting portion 12 changes the coordinate values (A2$x$, A3$y$) of E to the coordinate values (A2$x$, A2$y$) of C' in a stepwise fashion.

In the above embodiment, when a determination is made of a switching of the input video from a video in which halos easily appear to a video in which halos do not easily appear, there occurs a switching of the graph from the graph indicated by the solid line of FIG. 8(B) to the graph indicated by the solid line of FIG. 8(A).

At this time, the backlight luminance adjusting portion 12 alters the graph shape for use in a stepwise fashion over a predetermined number of frames, from the graph indicated by the solid line of FIG. 8(B) to the graph indicated by the solid line of FIG. 8(A). This allows the LED light emission luminance value at an input video gradation value to be altered in a stepwise fashion. Specifically, the backlight luminance adjusting portion 12 changes the coordinate values (A2$x$, A1$y$) of C' to the coordinate values (A2$x$, A3$y$) of E in a stepwise fashion.

Although in the above embodiment it is determined by producing the frequency distribution of the gradation values of an input video whether the input video is a video in which halos easily appear, this is not limitative but the determination may be made by use of another method.

The halo determining portion 10 may detect plural regions in an input video by linking together pixels having a luminance value within a predetermined range and detect a representative luminance value (e.g., a maximum luminance value or a mean luminance value) that represents each region.

For example, if a difference between a maximum gradation value and a minimum gradation value among representative gradation values greater than a predetermined gradation value is greater than or equal to a predetermined value, the halo determining portion 10 determines that the input video is a video in which halos easily appear, whereas if the difference is less than the predetermined value, it determines that the input video is not a video in which halos easily appear. The predetermined gradation value corresponds to the gradation value 20 of FIG. 4. The halo determining portion 10 sets the input video gradation values A and B described in FIG. 4 to the minimum gradation value and the maximum gradation value, respectively.

Although in the above embodiment, as described with reference to FIG. 2, the halo determining portion 10 extracts upper two gradation values 21 and 22 having greater frequencies in a range of the input video signal gradation value greater than the predetermined gradation value 20 and determines whether the input video is a video in which halos easily appear by detecting whether the ratio of a sum of frequencies of the two gradation values 21 and 22 to a sum of frequencies of gradation values within the range is greater than or equal to a predetermined ratio, hysteresis characteristics may be given to the predetermined ratio.

Specifically, the predetermined ratio is differently set in two different cases, one being a case of determining whether the input video signal gradation value represents a video in which halos easily appear in the state where the input video is determined not to be a video in which halos easily appear, the other being a case of determining whether the input video signal gradation value represents a video in which halos easily appear in the state where the input video is determined to be a video in which halos easily appear. For example, the predetermined ratio is set to 0.98 in the former case, while the predetermined ratio is set to 0.95 in the latter case.

By giving the hysteresis characteristics to the predetermined ratio in this manner, it is possible to suppress a frequent switching of the graph used in deciding the LED light emission luminance between the dashed dotted line graph and the solid line graph of FIG. 3 and reduce the visual uncomfortable feeling of the video caused by a sudden switching of the graph shapes.

Although in the above embodiment the backlight luminance adjusting portion 12 adjusts the LED light emission luminance using the solid line graph of FIG. 3 when the halo determining portion 10 determines whether the input vide is a video in which halos easily appear on a frame-by-frame basis or at a timing of detection of a scene change and if the input video is determined to be a video in which halos easily appear, the backlight luminance adjusting portion 12 may adjust the LED light emission luminance if it is determined by the halo determining portion 10 that input videos having a predetermined number of or more frames are determined consecutively to be a video in which halos easily appear.

The backlight luminance adjusting portion 12 may adjust the LED light emission luminance using the dashed dotted line graph of FIG. 3 if it is determined by the halo determining portion 10 that videos having a predetermined number of or more frames are determined consecutively not to be a video in which halos easily appear.

By determining whether the input video is a video in which halos easily appear using consecutive input videos having a predetermined number of or more frames in this manner, it is possible to suppress a frequent switching of the graph used in deciding the LED light emission luminance between the dashed dotted line graph and the solid line graph of FIG. 3 and reduce the visual uncomfortable feeling of the video caused by a sudden switching of the graph shapes.

Although in the above embodiment the light emission luminance 4 of LEDs corresponding to the gray pattern 1 is increased without increasing the light emission luminance of LEDs corresponding to the black pattern 8 as described in FIG. 5, the light emission luminance 5 of LEDs corresponding to the white pattern 2 may be reduced so that the appearance of halos can be suppressed even more. This processing will be described in detail hereinbelow.

FIG. 9 is an explanatory view of the display luminance obtained when no halo prevention measures are adopted. FIG. 9(A) depicts an example of the case of a small light leak in oblique view and FIG. 9(B) depicts an example of the case of a large light leak in oblique view. Such the degree of light leak varies depending on the panel characteristics such as gamma characteristic.

FIG. 9 depicts the light emission luminances 4 and 5 of LEDs defined by local dimming, the backlight luminance distribution 6 obtained as a result of the light emission of the LEDs, and a transmittance 31 of the liquid crystal panel 17 when the liquid crystal panel 17 is viewed from the front side. For example, the LED light emission luminance 4 is a light emission luminance of LEDs corresponding to the gray pattern 1 of FIGS. 15 to 18 and the LED light emission luminance 5 is a light emission luminance of LEDs corresponding to the white pattern 2 of FIGS. 15 to 18.

FIG. 9 depicts an expectation 30 of the display luminance for an input video to the liquid crystal panel 17, a transmittance 32 of the liquid crystal panel 17 obtained when the liquid crystal panel 17 is viewed obliquely, and a display luminance 33 of the liquid crystal panel 17 obtained when the liquid crystal panel 17 is viewed obliquely.

As depicted in a portion enclosed with an ellipse 40 of FIG. 9(A), there occurs a light leak in a region of the gray pattern 1 close to the white pattern 2, with the result that the transmittance 32 of the liquid crystal panel 17 obtained when viewing the liquid crystal panel 17 obliquely is greater than the transmittance 31 of the liquid crystal panel 17 obtained when viewing the liquid crystal panel 17 from the front side.

In the case of FIG. 9(B), the light leak is larger than the case of FIG. 9(A), with the result that as depicted in a portion enclosed with an ellipse 42 of FIG. 9(B), the transmittance 32 of the liquid crystal panel 17 obtained when viewing the liquid crystal panel 17 obliquely becomes even greater.

The display luminance 33 of the liquid crystal panel 17 obtained when viewing the liquid crystal panel 17 obliquely depends on the backlight luminance distribution 6 and on the transmittance 32 of the liquid crystal panel 17 obtained when viewing the liquid crystal panel 17 obliquely.

Therefore, in FIGS. 9(A) and 9(B), as depicted in portions enclosed with ellipses 41 and 43, the display luminance 33 of the liquid crystal panel 17 becomes larger in the region of the gray pattern 1 according as coming closer to the region of the white pattern 2, resulting in the appearance of halos.

FIG. 10 is an explanatory view of the display luminance obtained when the halo prevention measures are adopted. FIG. 10(A) depicts an example of the case of a small light leak in oblique view and FIG. 10(B) depicts an example of the case of a large light leak in oblique view.

In the example of FIG. 10(A), as depicted in a portion enclosed with an ellipse 44 of FIG. 10(A), the LED light emission luminance 4 in the gray pattern 1 region is greater than that of the example of FIG. 9(A). In consequence, the difference become smaller between the LED light emission luminance 4 in the gray pattern 1 region and the LED light emission luminance 5 in the white pattern 2 region, and the appearance of halos is suppressed as depicted in a portion enclosed with an ellipse 45 of FIG. 10(A).

Similarly, in the example of FIG. 10(B), the LED light emission luminance 4 in the gray pattern 1 region is greater than that of the example of FIG. 9(B). However, since the case of FIG. 10(B) has a larger light leak than FIG. 10(A), the transmittance 32 of the liquid crystal panel 17 becomes even larger when viewing the liquid crystal panel 17 obliquely, as depicted in a portion enclosed with an ellipse 46 of FIG. 10(B).

In consequence, as depicted in a portion enclosed with an ellipse 47 of FIG. 10(B), the display luminance 33 of the liquid crystal panel 17 sharply increases in the gray pattern 1 region according as approaching the white pattern 2 region, and the halo becomes conspicuous.

To suppress this, it is conceivable to further increase the light emission luminance 4 of LEDs corresponding to the gray pattern 1. FIG. 11 is an explanatory view of suppressing halos when the halo appears conspicuously.

In FIG. 11, as depicted in a portion enclosed with an ellipse 48, the light emission luminance 4 of LEDs corresponding to the gray pattern. 1 is even greater than the case of FIG. 10(B). In this case, there arises a problem that the LED light emission luminance 4 in the gray pattern 1 region becomes too large although the appearance of halos is suppressed due to the reduced difference between the LED light emission luminance 4 in the gray pattern 1 region and the LED light emission luminance 5 in the white pattern 2 region.

Thus, in this embodiment, the LED light emission luminance 5 is reduced in the region of the white pattern 2, instead of further increasing the LED light emission luminance 4 in the region of the gray pattern 1 as in FIG. 11.

FIG. 12 is an explanatory view of a halo suppression method according to the present invention. In this method, the LED light emission luminance 4 corresponding to the gray pattern 1 is increased as depicted in a portion enclosed with an ellipse 50 of FIG. 12, whereas the LED light emission luminance 5 corresponding to the white pattern 2 is reduced as depicted in a portion enclosed with an ellipse 51.

This results in reducing a difference between the LED light emission luminance 4 in the region of the gray pattern 1 and the LED light emission luminance 5 in the region of the white pattern 2, and suppressing the appearance of halos.

Since the difference between the light emission luminance 4 and the light emission luminance 5 can be reduced without increasing the LED light emission luminance 4 in the gray pattern 1 region to a large extent, an excessive rise of the luminance can be suppressed in the region of the gray pattern 1.

Figure 13:
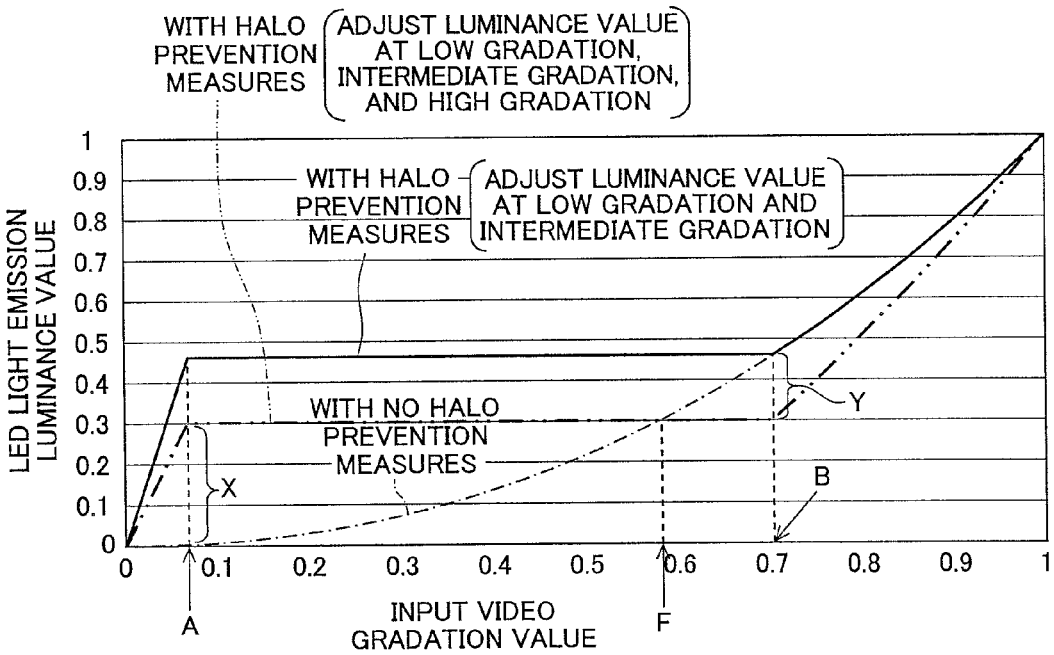
FIG. 13 is an explanatory view of a correction level calculation method of the LED light emission luminance in the halo suppression method depicted in FIG. 12.

FIG. 13 is an explanatory view of a method of calculating a correction level of the LED light emission luminance, effected in the halo suppression method depicted in FIG. 12. FIG. 13 depicts the solid line graph of FIG. 3 for comparison. A vertical axis of FIG. 13 represents an LED light emission luminance value and a horizontal axis thereof represents an input video gradation value. The vertical and horizontal axes are normalized using a maximum LED light emission luminance value and a maximum input video gradation value, respectively.

Similar to the case of FIG. 3, if the input video is determined not to be a video in which halos easily appear, local dimming is performed based on a dashed dotted line graph of FIG. 13. Specifically, in the local dimming, the backlight is divided into plural regions so that a gradation value of a video region corresponding to each divided region is detected. In this case, a maximum value or a mean value of gradation values of pixels contained in the video region is used as the gradation value of the video region. The LED light emission luminance of each divided region is decided from a relationship indicated by the dashed dotted line graph of FIG. 13 using the video region gradation value as an input video gradation value.

On the contrary, if the input video is determined to be a video in which halos easily appear, the graph for use in a decision of the LED light emission luminance is switched from the dashed dotted line graph of FIG. 3 to a dashed double-dotted line graph so that the LED light emission luminance is decided in each of the divided regions using the dashed double-dotted line graph. Although the dashed dotted curved line graph is set based on the 2.2 gamma characteristics in the example of FIG. 13, the relationship between the LED light emission luminance value and the input video gradation value may be represented by a straight line graph, and the dashed dotted line graph is defined in accordance with the definition of the input video gradation, i.e., so that the luminance expressed by the input video gradation is figured out.

If the input video gradation value is a value intermediate between A and F of FIG. 13, the LED light emission luminance value becomes larger in the case of the dashed double-dotted line graph than in the case of the dashed dotted line graph as well as the case of the solid line graph, whereas if the input video gradation value is a value greater than F, the LED light emission luminance value becomes smaller in the case of the dashed double-dotted line graph than in the case of the solid line graph and the dashed dotted line graph.

By deciding the LED light emission luminance using such the graphs, it is possible as described in FIG. 12 to prevent the difference between the LED light emission luminance 4 in the gray pattern 1 region and the LED light emission luminance 5 in the white pattern 2 region from increasing and hence to suppress the appearance of halos.

The range between A and B corresponds to a first range of claims, the range between 0 and A corresponds to a second range of claims, and the range between B and 1 corresponds to a third range of claims.

Figure 14:
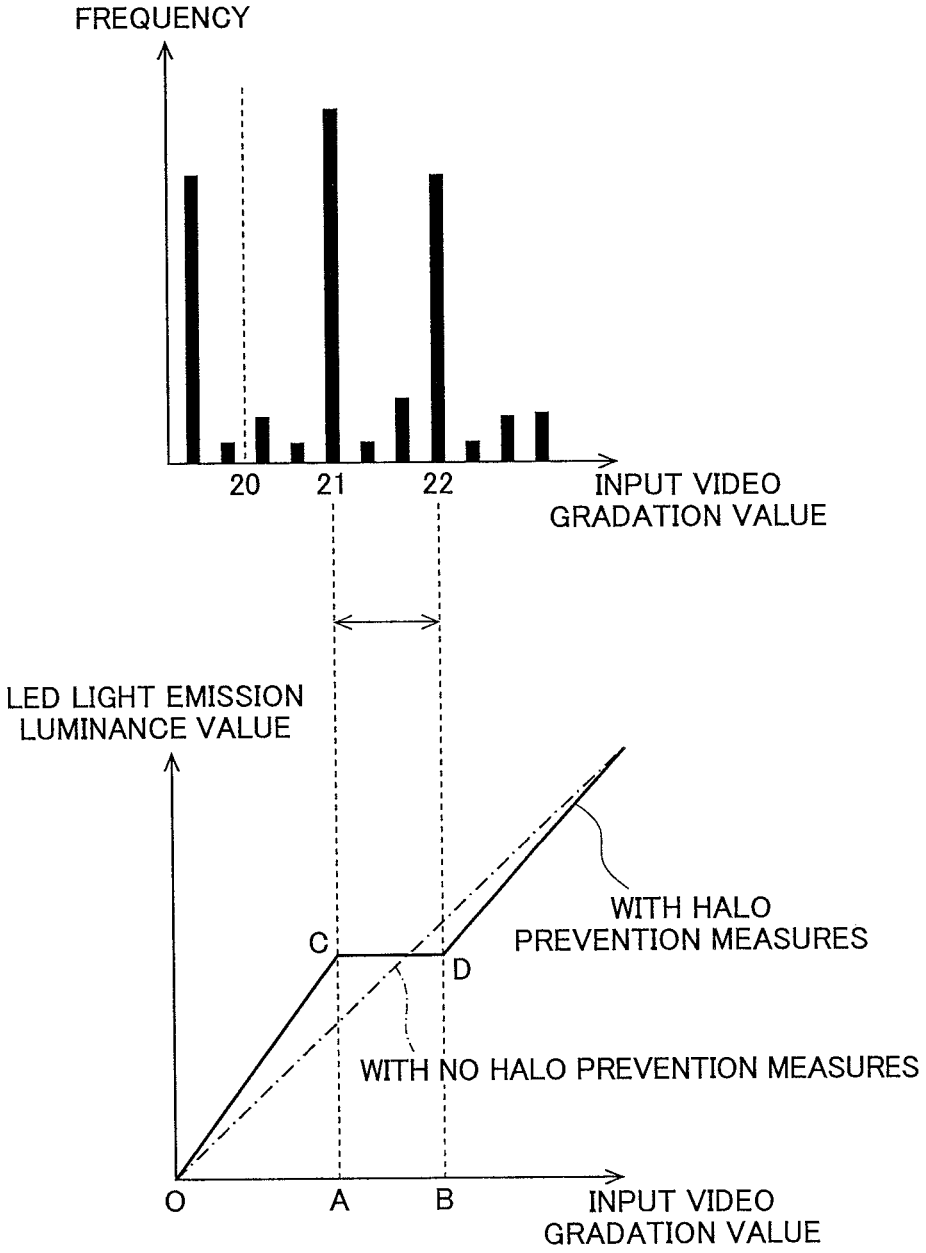
FIG. 14 is an explanatory view of a method of deciding input video gradation values A and B in FIG. 13.

The input video gradation values A and B of FIG. 13 are decided by the same method as that described in FIG. 4 for example. FIG. 14 is an explanatory view of a method of deciding the input video gradation values A and B in FIG. 13. Although in FIG. 14 the relationship between the LED light emission luminance value and the input video gradation value is expressed by the straight line graph, the input video gradation values A and B can be decided in the same manner in the case of the curved line graph expressed by the dashed double-dotted line of FIG. 13.

Specifically, when determining whether the input video is a video in which halos easily appear, the halo determining portion 10 of the video display device depicted in FIG. 1 produces a frequency distribution of the input video gradation values and extracts upper two gradation values 21 and 22 having greater frequencies in the range of the input video gradation value greater than the predetermined gradation value 20. The predetermined gradation value 20 corresponds to the gradation value 20 described in FIG. 2.

If it is determined by the halo determining portion 10 that the input video is a video in which halos easily appear, the correction level calculating portion 11 sets the input video gradation values A and B to values of the two gradation values 21 and 22.

If it is determined by the halo determining portion 10 that the input video is not a video in which halos easily appear, the correction level calculating portion 11, for example, sets the input video gradation values A and B to negative values or to B=A or outputs information of detection/non-detection to the backlight luminance adjusting portion 12, in order to disable the LED light emission luminance correction level from being calculated.

The method of setting the input video gradation values A and B is not limited to the above but other methods may be employed. For example, as described above, the halo determining portion 10 may detect plural regions in an input video by linking together pixels having a luminance value within a predetermined range and detect a representative luminance value (e.g., a maximum luminance value or a mean luminance value) that represents each region.

If a difference between a maximum gradation value and a minimum gradation value among representative gradation values greater than a predetermined gradation value is greater than or equal to a predetermined value, the halo determining portion 10 determines that the input video is a video in which halos easily appear, whereas if the difference is less than the predetermined value, it determines that the input video is not a video in which halos easily appear. The predetermined gradation value corresponds to the gradation value 20 of FIG. 14. The halo determining portion 10 sets the input video gradation values A and B described in FIG. 14 to the minimum gradation value and the maximum gradation value, respectively.

If the input video is determined to be a video in which halos easily appear, the graph for deciding the LED light emission luminance is switched from the dashed dotted line graph of FIG. 13 to the dashed double-dotted line graph, while the correction level calculating portion 11 decides a reduction amount Y of the LED light emission luminance value corresponding to the input video gradation value B using Equation 1 below from an increase amount X of the LED light emission luminance value corresponding to the input video gradation value A and the frequencies of the input video gradation values A and B in the frequency distribution of FIG. 14.

$$Y = X \times (\text{frequency of input video gradation value } A) / (\text{frequency of input video gradation value } B) \times (\text{adjustment coefficient}) \quad \text{(Eq. 1)}$$

However, if in the dashed double-dotted line of FIG. 13, the LED light emission luminance value corresponding to the input video gradation value B becomes smaller than the LED light emission luminance value corresponding to the input video gradation value A as a result of increase in the LED light emission luminance value corresponding to the input video gradation value A by the increase amount X and of reduction in the LED light emission luminance value corresponding to the input video gradation value B by the reduction amount Y, then the increase amount X is adjusted so that the LED light emission luminance value corresponding to the input video gradation value A becomes smaller than or equal to the LED light emission luminance value corresponding to the input video gradation value B.

For example, the input video gradation value A corresponds to the input video gradation value of the gray pattern 1 of FIG. 2 and the input video gradation value B corresponds to the input video gradation value of the white pattern 2 of FIG. 2. When performing the local dimming, as described in FIG. 12, the LED light emission luminance of the region corresponding to the gray pattern 1 is increased but the LED light emission luminance of the region corresponding to the white pattern 2 can be reduced since the display luminance of the region corresponding to the white pattern 2 increases due to the influence of light leaking from the region corresponding to the gray pattern 1. This means that the LED light emission luminance at the input video gradation value B can be smaller than the value of the dashed dotted line graph as depicted in FIG. 13.

In Equation 1, the frequency of the input video gradation value A may be replaced by the frequency of an input video gradation value included in the range of A1*a* (a is an integer) in view of the frequency distribution depicted in FIG. 14. The frequency of the input video gradation value B may be replaced by the frequency of an input video gradation value included in the range of B±β (β is an integer).

The influence of an increase in the LED light emission luminance of the region corresponding to the input video gradation value A on the luminance of the region corresponding to the input video gradation value B depends on a distance between the region corresponding to the input video gradation value A and the region corresponding to the input video gradation value B. For this reason, if information of the distance is acquired, the reduction amount Y can be an increase amount of the luminance of the region corresponding to the input video gradation value B without calculating the reduction amount Y using Equation 1.

In Equation 1, no consideration is given to the distance between the region corresponding to the input video gradation value A and the region corresponding to the input video gradation value B, and therefore the adjustment coefficient of Equation 1 is used to prevent the luminance from lowering excessively in the region corresponding to the input video gradation value B.

Although the shape of the dashed double-dotted line graph of FIG. 13 is altered depending on a change of the frequency distribution depicted in FIG. 14, the graph shape may be altered in a stepwise fashion as described in FIG. 7.

Similarly, although there occurs a switching of the graph from the dashed dotted line graph of FIG. 13 to the dashed double-dotted line graph if determination is made of a switching of an input video from a video in which halos do not easily appear to a video in which halos easily appear and although there occurs a switching of the graph from the dashed double-dotted line graph of FIG. 13 to the dashed dotted line graph if determination is made of a switching of the input video from a video in which halos easily appear to a video in which halos do not easily appear, but the graph shape may be altered in a stepwise fashion as described in FIG. 8. This enables a reduction of the incongruous feeling arising from a sharp change in the graph shape.

EXPLANATIONS OF LETTERS OR NUMERALS

1 . . . gray pattern, 2 . . . white pattern, 3 . . . divided region, 4, 5, 9 . . . LED light emission luminance, 6 . . . backlight luminance distribution, 7 . . . liquid crystal panel output gradation value, 8 . . . black pattern, 10 . . . halo determining portion, 11 . . . correction level calculating portion, 12 . . . backlight luminance adjusting portion, 12*a* . . . first luminance adjusting portion, 12*b* . . . second luminance adjusting portion, 13 . . . backlight control portion, 14 . . . backlight, 15 . . . liquid crystal gradation adjusting portion, 16 . . . liquid crystal control portion, 17 . . . liquid crystal panel, 20 to 22 . . . gradation value, 30 . . . display luminance (expectation), 31 . . . LCD transmittance (front view), 32 . . . LCD transmittance (oblique view), and 33 . . . display luminance (oblique view).

The invention claimed is:

1. A video display device having a display panel that displays a video in accordance with a video signal and a backlight that uses LEDs as light sources for illuminating the display panel, the video display device controlling a light emission luminance of the LEDs, for each of regions obtained by dividing the backlight into a plurality of regions, based on a predetermined relationship between a gradation value of a video region corresponding to each of the regions obtained by the division and the light emission luminance of the LEDs, the video display device comprising:

a first luminance adjusting portion that, if a gradation value of the video meets a predetermined condition, adjusts the light emission luminance of the LEDs such that a variation range of the light emission luminance of the LEDs in a first range, defined based on the predetermined condition, of the gradation value of the video region is smaller than a variation range of the light emission luminance of the LEDs defined based on the predetermined relationship; and a second luminance adjusting portion that adjusts the light emission luminance of the LEDs so as to be a smaller light emission luminance than a lower limit value of the light emission luminance of the LEDs adjusted by the first luminance adjusting portion in a second range smaller in value than the first range, wherein the predetermined condition is a condition that, when producing a frequency distribution of the gradation value of the video and extracting upper two gradation values having greater frequencies in a gradation range where the gradation value of the video is greater than the predetermined gradation value, a ratio of a sum of frequencies of the upper two gradation values to a sum of frequencies of the gradation values in the gradation range is greater than a predetermined ratio.

2. The video display device as defined in claim 1, wherein the predetermined ratio is set to different ratios between a case of determining whether the gradation value of the video meets the predetermined condition in a state where the gradation value of the video does not meet the predetermined condition and a case of determining whether the gradation value of the video meets the predetermined condition in a state where the gradation value of the video meets the predetermined condition.

3. The video display device as defined in claim 1, wherein the first luminance adjusting portion adjusts the light emission luminance of the LEDs if the gradation value of the video having a plurality of frames meets the predetermined condition consecutively over a predetermined number of the frames.

4. The video display device as defined in claim 1, wherein the first luminance adjusting portion adjusts the light emission luminance of the LEDs in the first range so as to be a light emission luminance smaller than a light emission luminance of the LEDs that is decided based on the predetermined relationship at an upper limit value of the first range.

5. The video display device as defined in claim 1, wherein the first luminance adjusting portion adjusts the light emission luminance of the LEDs in the first range so as to be a light emission luminance of the LEDs that is decided based on the predetermined relationship at an upper limit value of the first range.

6. The video display device as defined in claim 1, wherein if the second luminance adjusting portion detects that a ratio of the number of pixels having a gradation value smaller than a predetermined gradation value to the total pixels exceeds a predetermined ratio in the video signal, the second luminance adjusting portion adjusts only the light emission luminance of the LEDs so as to be smaller than a light emission luminance before the detection in the second range.

7. The video display device as defined in claim 1, further comprising an illuminance detecting portion that detects an ambient illuminance of the video display device, wherein if it is detected that the ambient illuminance is smaller than a predetermined value, the second luminance adjusting portion adjusts only the light emission luminance of the LEDs so as to be smaller than the light emission luminance before the detection in the second range.

8. The video display device as defined in claim 1, wherein when accepting a specification of a video display mode, the first luminance adjusting portion adjusts the light emission luminance of the LEDs using a relationship previously defined depending on the type of the video display mode such that a variation range of the light emission luminance of the LEDs in the first range of the gradation value of the video region is smaller than a variation range of the light emission luminance of the LEDs decided based on the predetermined relationship, and wherein the second luminance adjusting portion adjusts the light emission luminance of the LEDs using the relationship previously defined depending on the type of the video display mode so as to be a light emission luminance smaller in the second range than the lower limit value of the light emission luminance of the LEDs adjusted by the first luminance adjusting portion.

9. The video display device as defined in claim 1, wherein when adjusting the light emission luminance of the LEDs, the first luminance adjusting portion and/or the second luminance adjusting portion performs, over a predetermined number of frames, a stepwise change from a light emission luminance before the adjustment to a light emission luminance after the adjustment.

10. The video display device as defined in claim 1, wherein the first luminance adjusting portion adjusts the light emission luminance of the LEDs so as to be a light emission luminance smaller than the light emission luminance of the LEDs that is decided based on the predetermined relationship in a third range greater in value than the first range.

11. The video display device as defined in claim 10, wherein an adjustment amount Y of the light emission luminance of the LEDs in the third range is decided based on an adjustment amount X of the light emission luminance of the LEDs at a lower limit value in the first range, the frequency of a gradation value A of the video corresponding to the lower limit value of the first range, and the frequency of a gradation value B of the video corresponding to an upper limit value of the first range, from an equation $Y=X^x$ (frequency of gradation value A)/(frequency of gradation value B)×(adjustment coefficient).

* * * * *